United States Patent [19]

Amarantos

[11] 3,978,530

[45] Sept. 7, 1976

[54] AIR INFLATABLE BED-LIKE DEVICE WITH ADJUSTABLE BACK SUPPORT

[76] Inventor: John G. Amarantos, 6114 Gardenia Ave., Long Beach, Calif. 90805

[22] Filed: Nov. 21, 1975

[21] Appl. No.: 634,242

[52] U.S. Cl. ..... 5/68; 5/52; 5/66; 5/349

[51] Int. Cl.[2] ..... A61G 7/10

[58] Field of Search ..... 5/52, 60, 66–68, 5/75, 92, 348 R, 349

[56] References Cited

UNITED STATES PATENTS

| | | | |
|---|---|---|---|
| 1,269,746 | 6/1918 | Robeson | 5/349 |
| 1,323,610 | 12/1919 | Price | 5/349 |
| 2,604,641 | 7/1952 | Reed | 5/349 |
| 3,646,621 | 3/1972 | Frogas | 5/66 |
| 3,750,200 | 8/1973 | Hirmann | 5/68 |
| 3,781,928 | 1/1974 | Swallert | 5/68 |

*Primary Examiner*—Casmir A. Nunberg
*Attorney, Agent, or Firm*—William C. Babcock

[57] ABSTRACT

An air inflatable bed-like device for supporting either one or two users in outstretched positions, with the device including independently operable air actuated means to support the back of each user at a desired angle relative to the floor on which the device rests.

5 Claims, 8 Drawing Figures

FIG. 1
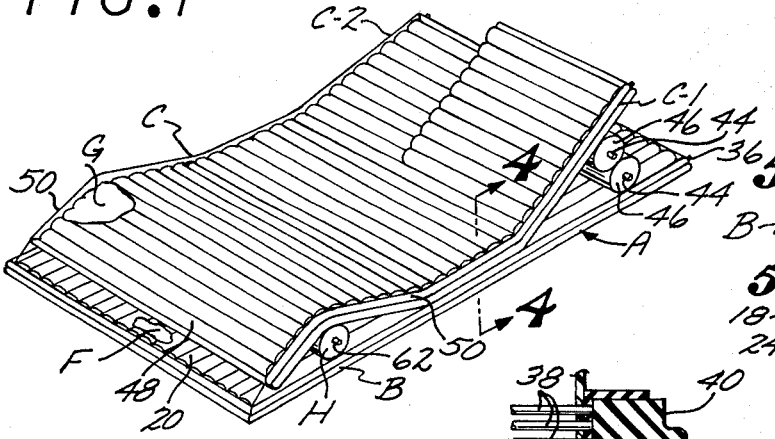
FIG. 3
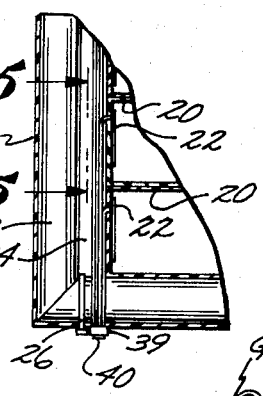
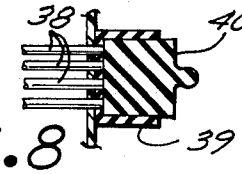
FIG. 8
FIG. 2
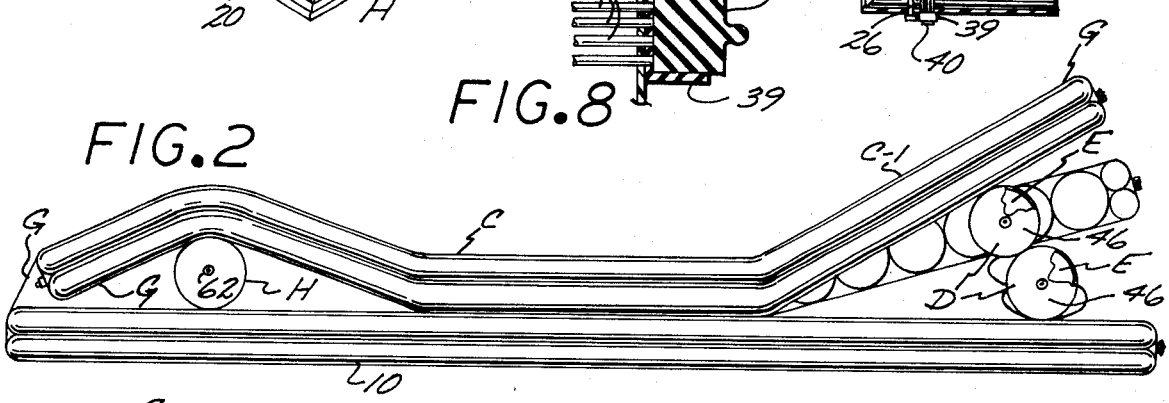
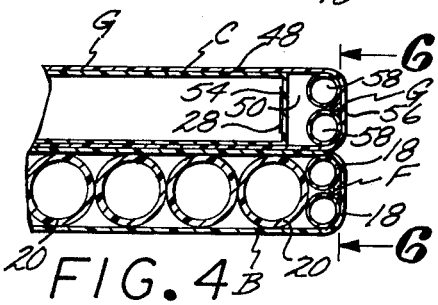
FIG. 4
FIG. 5
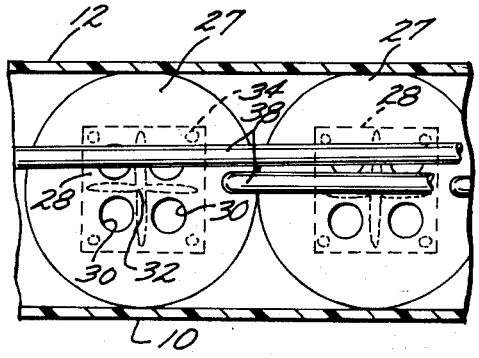
FIG. 6
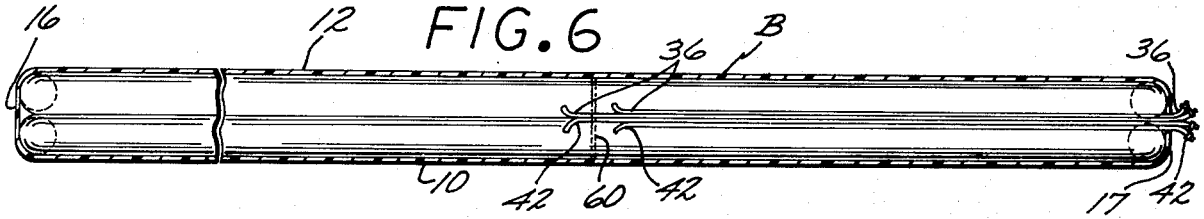
FIG. 7
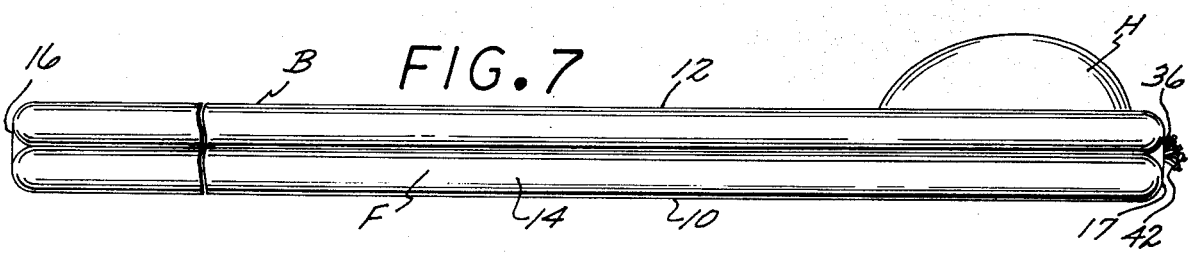

AIR INFLATABLE BED-LIKE DEVICE WITH ADJUSTABLE BACK SUPPORT

BACKGROUND OF THE INVENTION

1. Field of the Invention

Air inflatable bed-like device with adjustable back support.

2. Description of the Prior Art

In living quarters of restricted area it is frequently desirable to have a bed-like device or lounge that permits either one or two users to rest thereon in reclined positions, with each user having his back supported at a desired angle relative to the floor on which the device rests, and the device when not in use capable of being stored in a minimum of space. Prior to the present invention a device capable of providing the above-described operational advantages has not been available.

A major object of the present invention is to supply an inflatable bed-like device on which either one or two users are supported in reclining positions, and the device including independently operable back rests that may be adjusted to desired angles relative to the floor on which the device rests.

Another object of the invention is to furnish a device for the support of one or two users in reclining positions, and the device when not in use capable of being deflated and stored in a compact configuration in a minimum of space.

SUMMARY OF THE INVENTION

An air inflatable device including a base defined by a pliable sheet material. The base is of rectangular shape and has a number of longitudinally extending confined spaces defined therein, which confined spaces, when inflated, are constrained within an inflatable frame.

The base has a rectangular support of sufficient width that either one or two users may rest in a reclined position thereon. The support is likewise defined by pliable sheet material, and has a number of transverse confined spaces defined therein. The support includes two independently adjustable portions, and as a result each of these portions may be disposed at a desired angle. Each portion is adapted to have the back of a user rest thereon. The adjustment of each portion is attained by the use of first air actuated means. Second air actuated means are provided that arch the portion of the support on which the user's legs rest upwardly at a desired angle.

First tubular means and associated check valves permit the confined spaces in the base and support to be inflated with air from a source thereof under pressure. Second tubular means and manually operable means associated therewith permit the base, support, and the angle adjusting means to be deflated, with the device when in the deflated state capable of being folded and stored in a minimum of space.

BRIEF DESCRIPTION OF THE DRAWINGS

FIG. 1 is a perspective view of the inflatable bed-like device, with a first end of the back supports angularly disposed;

FIG. 2 is a side elevational view of the device;

FIG. 3 is a fragmentary longitudinal cross-sectional view of the base of the device;

FIG. 4 is a fragmentary vertical cross-sectional view of a portion of the device taken on the line 4—4 of FIG. 1;

FIG. 5 is a fragmentary transverse cross-sectional view of the device taken on the line 5—5 of FIG. 3;

FIG. 6 is a longitudinal cross-sectional view of the base;

FIG. 7 is a side elevational view of the base showing a first alternate form of adjustable back rest support; and FIG. 8 is a cross-sectional view of a plug valve structure.

DESCRIPTION OF THE PREFERRED EMBODIMENT

The invention A as may be seen in FIG. 1 includes a base B on which a support C for either one or two users (not shown) is mounted. The support C includes first and second back rests C-1 and C-2 respectively, that may be independently adjusted to desired angles relative to the base B by first and second air expandable devices D and E. The base B has a first envelope F that extends around the frame. A second envelope G extends around the support C and back rests C-1 and C-2. Both the base B and support C are defined by a pliable sheet material, and the base and support when inflated being of the configuration shown in FIG. 1. When the base B and support C are deflated, the base and support may be folded and stored in a compact configuration in a minimum of space.

The first envelope F includes a bottom 10, top 12, a pair of side walls 14, and first and second end walls 16 and 17. A pair of continuous restraining tubes 18 that are endless and of rectangular shape are situated within the first envelope F and in abutting contact with the interior surfaces of side walls 14 and first and second end walls 16 and 17. A number of longitudinally extending supporting tubes 20 are situated within first envelope F and disposed within the interior space defined by the restraining tubes 18. The longitudinally extending tubes 20 have first end pieces 22 that cooperate with first end walls 16 to define a transverse confined space 24 therebetween. Air under pressure may be supplied to space 24 by an air inlet 26.

Each of the first end pieces 27 have a check valve 28 mounted thereon, which valve is of the structure shown in FIG. 5. Each valve 28 includes a number of spaced ports 30 formed in the first end piece 27, with the ports being disposed about a central portion 32 of the end piece. Each central portion 32 on the interior surface thereof has a flap 34 of resilient material adhered thereto. Each flap 34 is of sufficient size as to extend over the ports 30 associated therewith.

The surface portions of each flap 34 aligned with ports 30 is less than the surface of the flap exposed to air under pressure within the tube 20 associated therewith. Air under pressure in space 24 can flow therefrom through ports 30 into the confines by the tubes 20. When the pressure of air in the tubes 20 is greater than the pressure of air in space 24, the differential in surface areas of the exterior and interior surfaces of the flap in communication with the ports 30 and the interiors of the tubes 20 will cause the flaps to be forced into sealing contact with the interior surfaces of first end pieces 22. Thus, the tubes 20 may be inflated with air under pressure, and will remain inflated even though the pressure in space 24 is reduced to that of the ambient atmosphere. The restraining tubes 18 are preferably inflated by an independent air inlet 36.

Each of the tubes 20 preferably has a conduit 38 in communication with the interior thereof as shown in FIG. 5, and these conduits extending to the apertured end of a cup shaped member 39 that is removably and sealingly engaged by a plug 40. By removing the plug 40, the base B may be deflated. A valved air outlet 42 permits air to be discharged from the restraining tubes 18. The first and second air actuated adjustment D and E are of identical structure and each includes a pair of inflatable bags or tubes 46 that may be inflated and deflated by air passing through valved conduits 44.

The support C includes a number of transverse pliable tubes 48 that extend between first and second longitudinal transversely spaced headers 50. The outwardly disposed end pieces 54 of the tubes 48 cooperate with the side walls 56 of the second envelope G to define the headers 50. The headers 50 have pairs of inflatable restraining tubes 58 therein. The headers 50 are in communication with valves 28 in the end pieces 54, and also have tubes 38 extending therethrough. Air under pressure is discharged into the headers 50 through inlets 26 as previously described, and air is discharged from the tubes 48 by conduits 38 also as previously described. The first and second air actuated adjustments E and F are but half the width of the support C downwardly from the back rests C-1 and C-2, and as a result each back rest may be independently adjusted to a desired angle relative to the base B. A third air actuated adjustment H extends transversely across base B and under support C to permit the portion of the support adjacent thereto to be bowed upwardly to a desired degree as shown in FIG. 1. Air is discharged into and out of adjustment H by a valved conduit 62. The elements above described are mainly formed from a pliable sheet material that may be inflated into the configuration shown in FIG. 1, or deflated and folded to be stored in a minimum of space. Should it be desired the first and second air actuated adjustments D and E may be replaced by inflatable bags H as shown in FIG. 7.

The under central portion of the second envelope G is bonded to the upper central portion of the first envelope F to maintain the invention A in the configuration shown in FIG. 1 when the invention is inflated. The restraining tubes 18 may be divided into two portions if desired by transverse partitions 60 as shown in FIG. 6.

The use and operation of the invention has been explained previously in detail and need not be repeated.

I claim:

1. An air inflatable bed-like structure that includes:

a. a base assembly that includes an elongate rectangular first envelope of pliable sheet material, which first envelope has a top, bottom, pair of side walls, and first and second end walls; at least one endless resilient restraining tube disposed inside said first envelope that is in abutting contact with the interior surfaces of said first and second end walls and said pair of side walls when said restraining tube is inflated with a fluid; first means for inflating said restraining tube with fluid under pressure; second means for permitting fluid to discharge from said restraining tube to deflate the latter; a plurality of elongate resilient first tubes longitudinally disposed inside said first envelope and within the confines of said restraining tube, said first tubes having first end pieces that cooperate with a portion of said restraining tube to provide a transverse first confined space within said first envelope; third means for discharging air under pressure into said first confined space; first check valve means on said first end pieces that permit air under pressure to flow from said first confined space into said first tubes to inflate the latter; and fourth means for deflating said first tubes;

b. a support assembly that includes an elongate rectangular second envelope of pliable sheet material,. which first envelope has a top, bottom, pair of side walls, and first and second ends; a plurality of resilient inflatable second tubes transversely disposed side by side in said second envelope, each of said second tubes having a pair of end walls; a pair of pliable headers that extend longitudinally relative to said second envelope; fourth means for discharging air under pressure into said pair of headers; second check valve means on said end walls for permitting air under pressure in said headers to flow into said second tubes to inflate the latter; fifth means for discharging air from said headers to deflate the latter; sixth means for discharging air from said second tubes to deflate the latter; and seventh means intermediate said first and second ends of said second envelope for bonding the bottom of the latter to the top of said first envelope, with said seventh means so securing said second envelope that first and second longitudinally spaced portions of said support assembly may be moved upwardly relative to said base assembly when both said base assembly and support assembly are inflated;

c. eighth vertically adjustable means disposed on said base and under said first portion of said support assembly that may be actuated to dispose said first portion in an upwardly angled position to support the leg portions of a user; and d. ninth vertically adjustable means disposed on said base and under said second portion of said support assembly that may be actuated to dispose said second portion at an angled position to support the back of a user.

2. An air inflatable bed-like structure as defined in claim 1 which in addition includes:

e. air inflatable stiffening means within said headers for maintaining said supporting assembly in an elongate rectangular configuration.

3. An air inflatable bed-like structure as defined in claim 1 in which said eighth means is an inflatable resilient body, and said air inflatable bed-like structure in addition including:

e. tenth valved means for inflating said resilient body with air under pressure; and f. eleventh valved means for permitting air to escape from said resilient body to deflate the latter.

4. An air inflatable bed-like structure as defined in claim 1 in which said ninth means is an inflatable resilient body, and said air inflatable bed-like structure in addition including:

e. tenth valved means for inflating said resilient body with air under pressure; and f. eleventh valved means for permitting air to escape from said resilient body to deflate the latter.

5. An air inflatable bed-like structure as defined in claim 1 in which said second portion of said support assembly is divided into two first and second longitudinally extending parts, with each of said parts having one of said ninth means associated therewith.

* * * * *